US005255613A

United States Patent [19]

Shuert

[11] Patent Number: 5,255,613

[45] Date of Patent: Oct. 26, 1993

[54] RACKABLE PLASTIC PALLET

[76] Inventor: Lyle H. Shuert, 70 Kingsley Manor Drive, Bloomfield Hills, Mich. 48304

[21] Appl. No.: 851,231

[22] Filed: Mar. 12, 1992

Related U.S. Application Data

[63] Continuation of Ser. No. 524,299, May 15, 1990, abandoned, which is a continuation-in-part of Ser. No. 484,369, Feb. 26, 1990, abandoned.

[51] Int. Cl.[5] ..... B65D 19/38

[52] U.S. Cl. ..... 108/52.1; 108/901

[58] Field of Search ..... 108/51.1, 52.1, 57.1, 108/901

[56] References Cited

U.S. PATENT DOCUMENTS

| | | | |
|---|---|---|---|
| 3,467,032 | 9/1969 | Rowlands | 108/901 |
| 3,667,403 | 6/1972 | Angelbeck | 108/901 |
| 3,699,902 | 10/1972 | Allgeyer et al. | 108/58 |
| 3,707,929 | 1/1973 | Lauffer | 108/51 |
| 3,717,922 | 2/1973 | Witkowski | 108/51.1 |
| 3,719,157 | 3/1973 | Arcocha et al. | 108/51 |
| 3,757,704 | 9/1973 | Allgeyer | 108/901 |
| 3,832,955 | 9/1974 | Pottinger et al. | 108/51.1 |
| 4,159,681 | 7/1979 | Vandament | 108/51.1 |
| 4,267,780 | 5/1981 | Candella | 108/52.1 |
| 4,488,496 | 12/1984 | Polacco | 108/51.3 |
| 4,735,151 | 4/1988 | Hemery | 108/56.1 |
| 4,879,956 | 11/1989 | Shuert | 108/901 |

FOREIGN PATENT DOCUMENTS

| | | | |
|---|---|---|---|
| 2008325 | 1/1970 | France | 108/51.1 |

*Primary Examiner*—Kenneth J. Dorner
*Assistant Examiner*—Gerald A. Anderson
*Attorney, Agent, or Firm*—Krass & Young

[57] ABSTRACT

A plastic pallet in which a base structure is positioned beneath the plastic main body of the pallet to discourage warpage and failure of the pallet especially in racked, loaded storage situations. The plastic structure of the pallet includes a planar platform section defining an upwardly facing load receiving surface and a plurality of legs extending downwardly from the platform section to define tunnels therebetween for receipt of the forks of a forklift truck. The base structure includes a lower plastic sheet, an upper plastic sheet, and a plurality of tubular metallic beams positioned in hollows defined between the upper and lower plastic sheets. The hollows in which the beams are received between the sheets are defined within ribs formed on the upper face of a lower planar portion of the base structure and the ribs are respectively secured to respective rows of legs of the main body structure by locally heating the upper faces of the ribs and locally heating the bottoms of the legs of the main body structure to a fusible condition and thereafter pressing the main body structure and the base structure together to fuse the structures together at the interface between the ribs of the base structure and the bottoms of the legs of the main body structure.

18 Claims, 4 Drawing Sheets

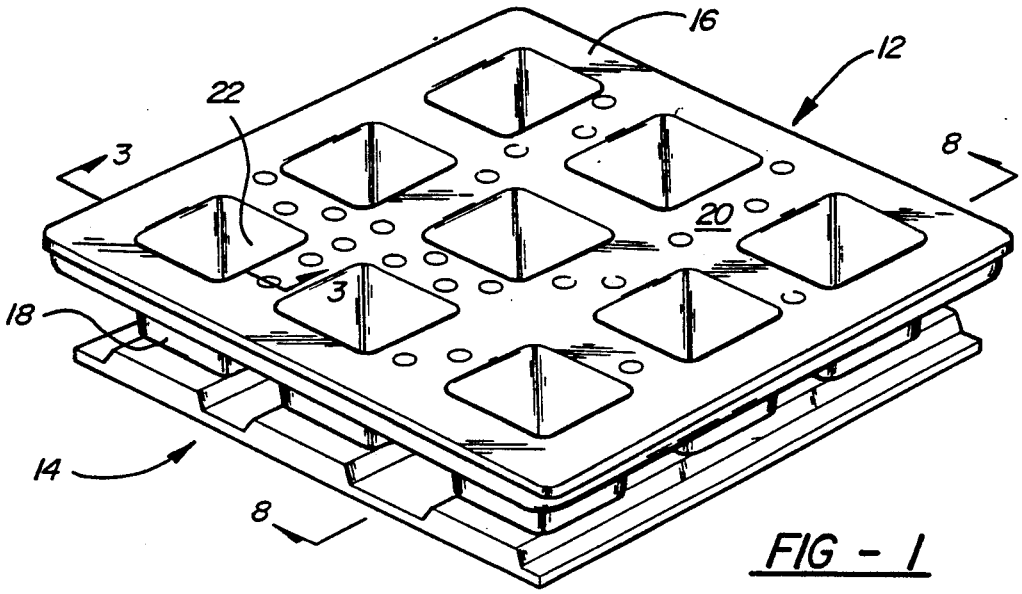
FIG - 1
FIG - 3
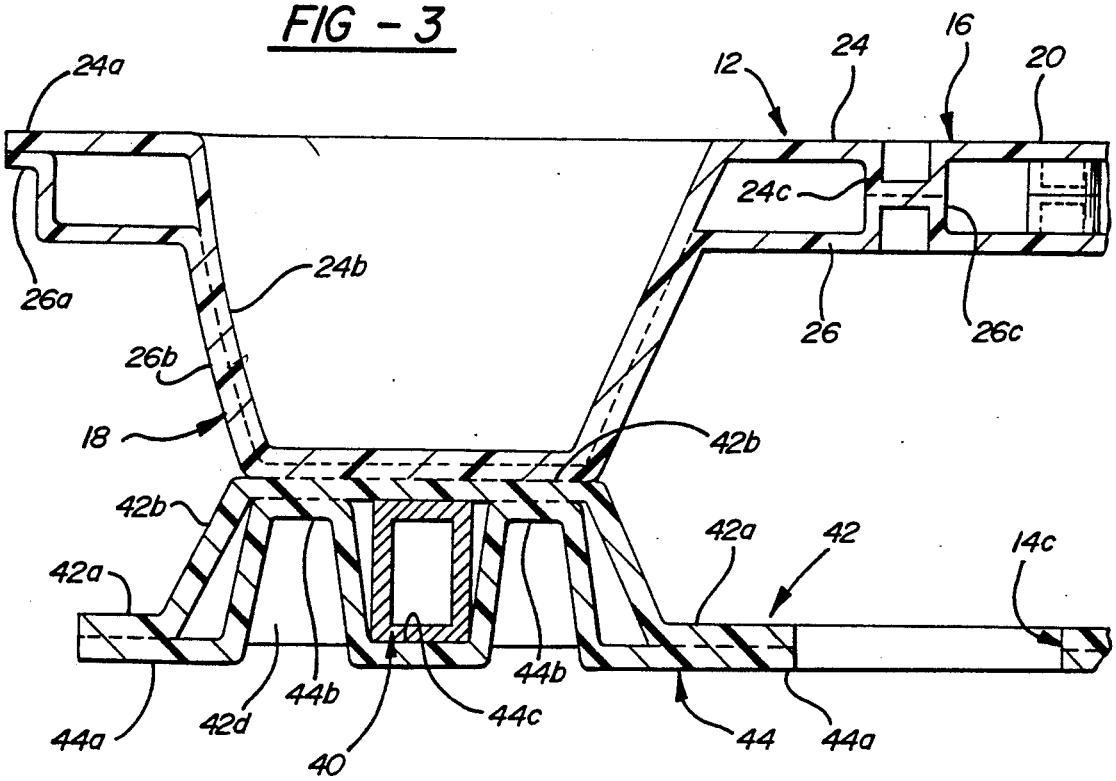

RACKABLE PLASTIC PALLET

RELATED APPLICATION

This is a continuation of co-pending application Ser. No. 524,299 filed on May 15, 1990, now abandoned which is a continuation-in-part of U.S. patent application Ser. No. 484,369 filed on Feb. 26, 1990, now abandoned.

BACKGROUND OF THE INVENTION

This invention relates to shipping and storage pallets and more particularly to pallets having a plastic construction.

Pallets have traditionally been formed of wood. Wood pallet however have many disadvantages. For example, they are subject to breakage and thus are not reusable over an extended period of time. They also take up a considerable amount of valuable floor space in the warehouse when they are not in use. They are also difficult to maintain in a sanitary condition, thus limiting their usability in applications where sanitation is important, such for example as in food handling applications. In an effort to solve some of the problems associated with wood pallets, plastic pallets have been employed with some degree of success. In one generally successful form of plastic pallet design, a twin sheet construction has been used in which upper and lower plastic sheets are formed in separate molding operations and the two sheets are then selectably fused or knitted together in a suitable press to form a reinforced double wall structure. Whereas these twin sheet plastic pallets are generally satisfactory, when they are stored in a rack in a loaded condition, the plastic material of the pallet over a period of time may tend to creep with the result that the platform structure of the pallet may warp to an extent that the pallet becomes disengaged from the rack support members and the pallet, with its load, falls out of the rack. The pallet warpage also creates problems with respect to automatic retrieval systems which depend for their successful operation on the pallet maintaining an essentially unwarped configuration. Attempts have been made to avoid these warpage problems in plastic pallets by arranging some manner of stiffening insert assembly in association with the plastic main body of the pallet, but these prior art stiffening arrangements have tended to be unduly complicated and unduly expensive.

SUMMARY OF THE INVENTION

This invention is directed to the provision of a plastic pallet which is extremely resistent to creepage or warpage.

More specifically, this invention is directed to the provision of a plastic pallet which may be stored on a rack in a loaded condition over extended periods of time without incurring any significant creep or warpage.

The invention is further directed to an improved method for forming a plastic pallet.

The invention pallet comprises a main body plastic structure defining a planar platform section defining an upwardly facing load receiving surface and a base structure positioned beneath the platform section, secured to the main body plastic structure, and including a plurality of beam members extending parallel to the load receiving surface of the main body structure. This arrangement preserves the advantages of a plastic pallet while avoiding the warpage and creepage problems normally associated with plastic pallets.

According to a further feature of the invention, the main body plastic structure includes a plurality of legs extending downwardly from the platform section and the base structure is secured to the bottoms of the legs. This arrangement provides an efficient and convenient means of mounting the base structure to the main body plastic structure.

According to a further feature of the invention, the base structure includes a plurality of raised portions extending from a location proximate one side edge of the base structure to a location proximate another side edge of the base structure and a beam member is coextensive with each raised portion of the base structure. This arrangement provides a convenient and effective means of packaging the beam members relative to the remainder of the pallet.

According to a further feature of the invention, each beam member comprises a metallic tubular beam. This arrangement allows inexpensive and commercially available tubular stock to be employed in the construction of the invention pallet.

According to a further feature of the invention, the base structure includes a plastic housing encapsulating each beam. This arrangement provides a convenient means of incorporating the beams into the base structure.

According to a further feature of the invention, the base structure is formed as a twin sheet structure including a first plastic sheet overlying the beams fused to a second plastic sheet underlying the beams. This arrangement allows the known and effective twin sheet technology to be employed in the construction of the base structure of the pallet.

According to a further feature of the invention, the base structure is secured to the plastic structure by fusing the upper faces of the plastic housings of the base structure to lower faces of the plastic structure. This arrangement provides a simple, effective and inexpensive means of rigidly securing the upper and lower sections of the pallet together to form the final pallet assembly.

According to a further feature of the invention, the base structure includes a generally planar lower portion and the beam members are positioned on the lower portion. This arrangement provides a flat lower foot portion to firmly plant the pallet on its associated support surface while further providing means to mount the beam members to the base structure.

According to an important feature of the invention methodology, a plastic pallet is formed by forming a main body plastic structure defining a planar platform section defining an upwardly facing load receiving surface; forming a base structure generally conforming in size and shape to the main body plastic structure; heating local area on the under side of the main body plastic structure and on the upper side of the base structure; and, with the local areas in a heated fusible condition, pressing the local areas on the under side of the main body plastic structure against the local areas on the base structure to fuse the local areas together to form the pallet. This arrangement provides an inexpensive and effective method of forming a plastic pallet having excellent rackability characteristics.

According to a further feature of the invention methodology, the main body plastic section includes a plurality of legs extending downwardly from the platform section and the heating step includes heating the under sides of the legs and confronting surfaces on the upper side of the base section. This methodology provides a convenient and effective means of securing the base structure to the under side of the platform section of the main body plastic structure.

According to a further feature of the invention methodology, the heating step comprises positioning the under sides of the legs against one face of a platen, positioning the confronting surfaces on the upper side of the base structure against an opposite face of the platen, heating the platen to heat the under sides of the legs and the confronting surfaces on the base structure, and the platen is thereafter removed to allow the local areas on the main body plastic structure and on the base structure to be pressed together to form the final pallet assembly. This methodology provides a rapid and inexpensive means of fusing the sections of the pallet together to form the final pallet assembly.

According to a further feature of the invention, the pallet includes a main body structure defining a planar platform section defining an upwardly facing load receiving surface and a base structure positioned beneath the main body structure and including a lower planar member having a flat lower surface adapted to support the pallet on a support structure, spaced below the platform section of the main body structure to define tunnels therebetween for the entry of material handling equipment, and including aperture means extending therethrough. This arrangement allows elements of material handling equipment positioned in the tunnels to access the support surface for the pallet to facilitate lifting of the pallet by the material handling equipment.

According to a further feature of the invention, the main body structure further includes a plurality of legs extending downwardly from the platform section and the base structure is secured to the under sides of the legs. This arrangement provides the required spacing between the platform structure and the lower planar member to define the material handling tunnels.

According to a further feature of the invention, the legs of the main body structure are arranged in rows; the base structure further includes beam members positioned in parallel relation on the upper side of the lower planar member with each beam member positioned beneath a respective row of legs; and the aperture means comprise openings in the lower planar member between adjacent beam members. This arrangement allows material handling equipment of the type commonly referred to as a "lowboy" to enter the tunnels between adjacent beams by riding over the lower planar member and thereafter positioning the wheels of the lowboy in the openings in the lower planar member to allow the wheels to react against the support surface to allow the lowboy to lift the pallet.

BRIEF DESCRIPTION OF THE DRAWINGS

FIG. 1 is a perspective view of a plastic pallet according to the invention;

FIG. 3 is a cross-sectional view taken on line 3—3 of FIG. 1;

DETAILED DESCRIPTION OF THE PREFERRED EMBODIMENT

Figure 2:
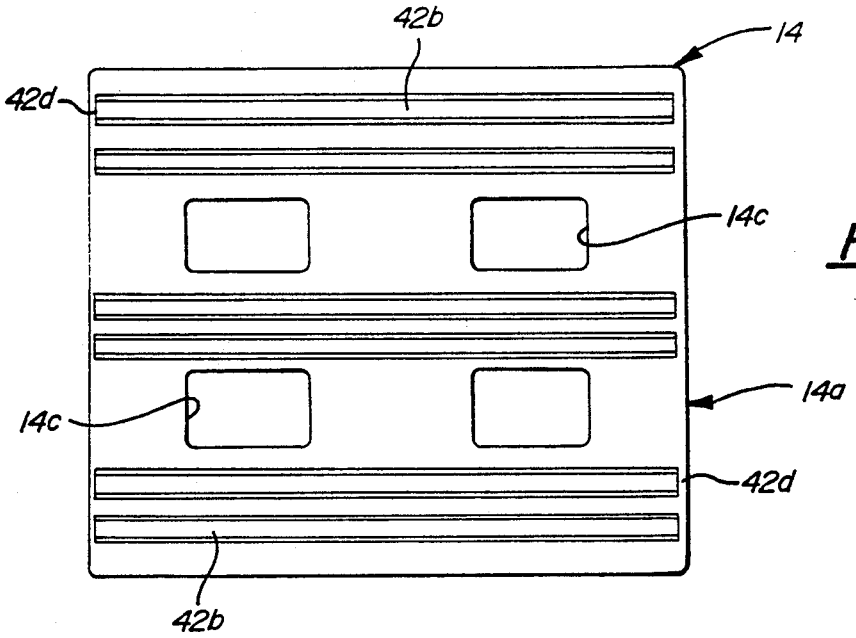
FIG. 2 is a bottom view of the invention pallet.

The invention pallet 10, broadly considered, includes a main body plastic structure 12 and a base structure 14.

Main body plastic structure 12 includes a planar platform section 16 and a plurality of legs 18 extending downwardly from the platform structure. Platform structure 16 defines an upwardly facing planar load receiving surface 20, and legs 18 are hollow and open upwardly in load receiving surface 20 to form a plurality of rectangular openings 22 in the load receiving surface 20. For example, nine legs may be provided with one leg at each corner of the pallet, an intermediate leg along each side of the pallet, and a central leg.

Plastic structure 12 embodies a twin sheet construction and is formed by vacuum forming an upper polyethylene plastic sheet 24, vacuum forming a lower polyethylene plastic sheet 26, and thereafter fusing the two sheets together at selected points to form the final plastic structure. The fusion or knitting points are illustrated in the drawings by dashed lines between the upper sheet 24 and the lower sheet 26. As shown, the upper and lower sheets may be fused or knitted at the interface of peripheral flange portions **24*a*, 26*a*; at the interface of downwardly extending leg portions 24*b*, 26*b*; and at the interface of downwardly extending protrusions 24*c* on the upper sheet 24 and upwardly extending protrusions 26*c* on the lower sheet 26**. Further details of the manner in which a plastic twin sheet pallet of this general construction may be formed are disclosed in U.S. Pat. No. 4879956 assigned to the assignee of the present application.

Base structure 14 includes a plurality of beams 40, an upper plastic sheet 42, and a lower plastic sheet 44. Each beam 40 may comprise, for example, a rolled steel tubular member having a generally rectangular cross-sectional configuration.

Plastic sheets 42 and 44 are preferably formed of polyethylene. Base structure 14 is fabricated by forming sheet 42, preferably in a vacuum forming operation, into the convoluted, generally sinusoidal configuration, best seen in FIG. 4, including base portions **42*a* and a plurality of parallel upstanding rib portions 42*b*; forming sheet 44, preferably in a vacuum forming operation, into a convoluted configuration, best seen in FIG. 4, including base portions 44*a* and parallel pairs of raised rib portions 44*b* each defining an upwardly opening groove 44*c* therebetween; placing a beam 40 in each groove 44*c*; placing upper sheet 42 over lower sheet 44 with each raised rib portion 42*b* overlying and encapsulating a respective pair of rib portions 44*b* and with each raised rib portion 42*b* coacting with a respective groove 44*c* to encapsulate the respective beam 40 within groove 44*c***.

Figure 5:
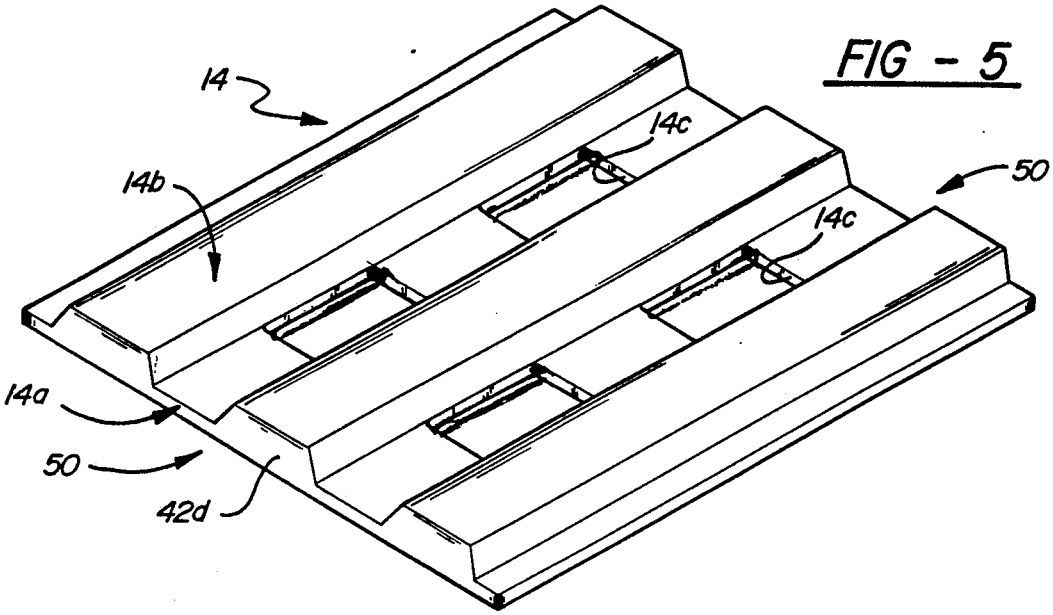
FIG. 5 is a perspective view of the base structure of the invention pallet.

Upper and lower sheets 42, 44 are brought together while still in a heated, fusible condition to selectively fuse portions of the upper sheet to portions of the lower sheet. Specifically, the under sides of base portions **42*a* of upper sheet 42 are fused to the upper sides of base portions 44*a* of lower sheet 44 and the under sides of ribs 42b are secured to the upper sides of ribs 44b to encapsulate beams 40 and form the final base structure, as best seen in FIG. 5. The completed base structure comprises a planar lower or foot portion 14a formed of the fused together base portions 42a, 44a of the upper and lower sheets and a plurality of rib portions 14b formed of the fused together base portions 42b, 44b of the upper and lower sheets encapsulating the respective beams 40. Base structure 14 also includes a plurality of generally rectangular openings or apertures 14c in the planar lower or foot portion 14a of the base structure between adjacent rib portions 14b. Preferably, and as shown, four apertures 14c are provided with two apertures between each pair of adjacent rib portions 14b**.

As best seen in FIG. 5, the ends 50 of the base structure 14 include plastic end portions 42d, vacuum formed as part of the upper sheet 42, which act in the completed base structure to cover the otherwise exposed ends of the beams 40 so as to preclude the entry of contaminants and moisture into the base structure and present an aesthetically pleasing appearance. It will be understood that end portions 42d of upper sheet 42 are fused, during the formation of the base structure, to the end edge faces of the respective rib pairs 44b of the lower sheet 44.

Figure 4:
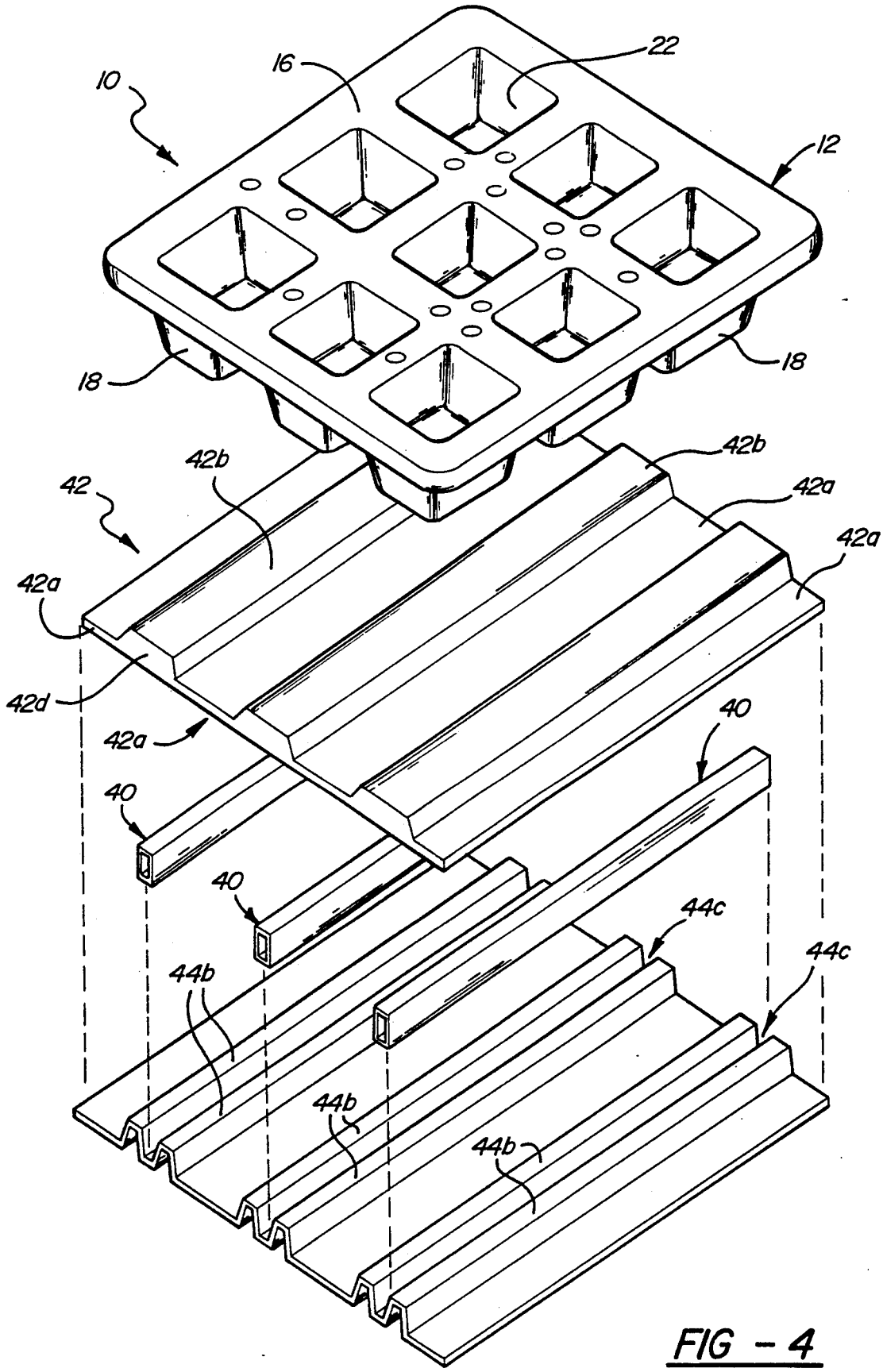
FIG. 4 is an exploded perspective view of the invention pallet.

As best seen in FIGS. 1 and 4, the legs 18 of main body structure 12 are arranged in three parallel rows with three legs in each row and the base structure 14 is positioned beneath main body structure 12 with each rib portion 14b mounted beneath and extending along a row of legs so that each rib portion 14b coacts at its upper face with the lower side of three legs.

The base structure 14 has an overall size and shape generally corresponding to the overall size and shape of the main body section 12 and is positioned beneath the main body structure 12 such that the edges of the base structure are generally coextensive with the corresponding edges of the main body structure.

Figure 6A:
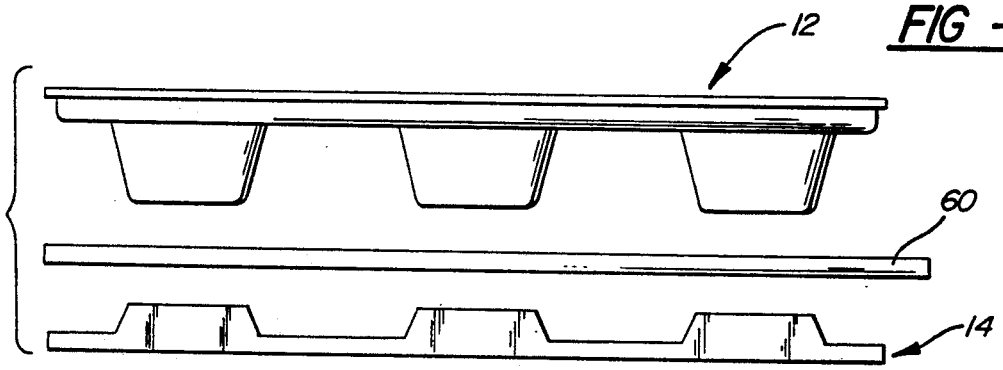
FIG. 6 illustrates steps in the formation of the invention pallet.
Figure 6B:
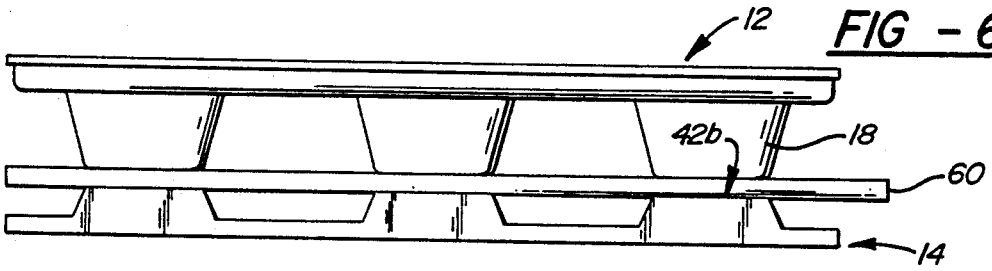
Figure 6C:
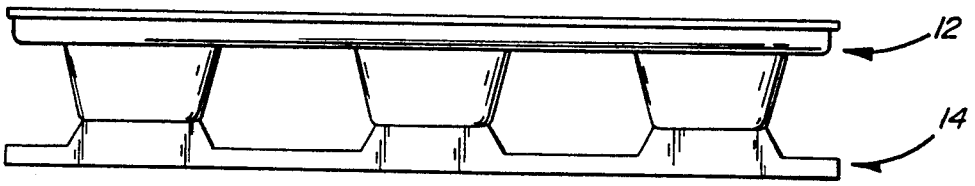

To secure the base structure 14 to the main body structure 12, and as best seen in FIG. 6, the main body structure 12 is positioned above a platen 60 and the base structure 14 is positioned beneath the platen 60 (as seen in FIG. 6a); the main body structure 12 and the base structure 14 are brought into contacting relation with the upper and lower faces of the platen 60 (as best seen in FIGS. 6b) with the lower or bottom sides of the legs 18 contacting the upper face of platen 60 and the upper faces of rib portions 42b contacting the lower face of the platen; the platen is suitably heated as by electric means to render the plastic material contacting the platen fusible; and (as seen in FIG. 6c) the base structure and main body structure are moved away from the platen, the platen is removed, and the base structure and main body structure are brought together to press the lower or bottom sides of the legs against the upper faces of the rib portions 42b to fuse or knit the plastic material of the main body structure and of the base structure at their interfaces to form the final pallet assembly.

Figure 7:
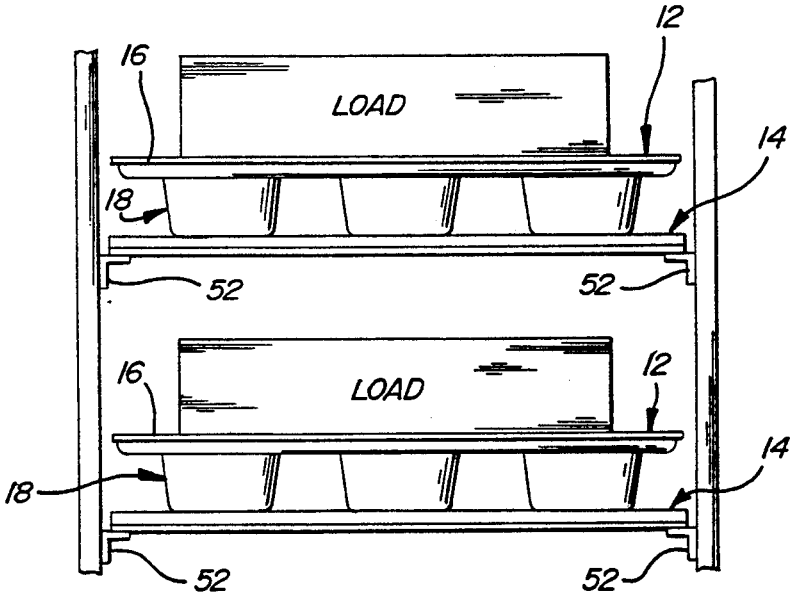
FIG. 7 illustrates the invention pallet employed in a rack structure in a loaded configuration.

The invention pallet will be seen to retain all of the advantages of a plastic pallet while overcoming the disadvantages of prior art plastic pallets. Specifically, the invention pallet is especially effective in situations, as seen in FIG. 7, where the pallet is loaded and placed in a loaded condition on a storage rack with the pallet supported by the ends of the base structure. When thus racked, the base structures acts to preclude creepage or warpage of the pallet even over extended periods of storage, thus avoiding the problem with prior art plastic pallets which, when utilized in the loaded, racked situation shown in FIG. 7, have tended to creep and warp over a period of time with the result that the pallets have become disengaged from the mounting brackets 52 and the pallets, with their loads, have fallen out of the rack. The invention pallet, by avoiding pallet warpage, also overcomes the problem with prior art pallets wherein the pallets, after extended periods of use, assume a warpage that complicates their handling by standardized automatic retrieval equipment. The foot or lower portion of the base structure of the invention pallet also provides a flat, extensive footprint for the pallet to provide a firm footing for the pallet and facilitate movement of the pallet even over irregular transfer surfaces.

Figure 8:
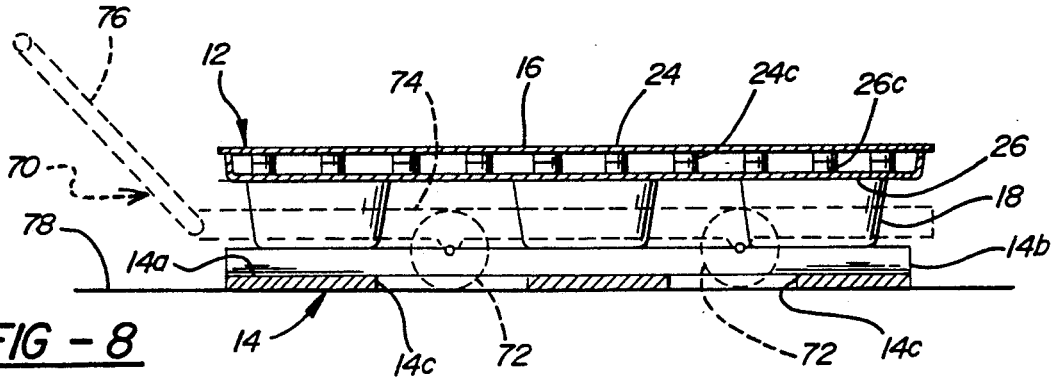
FIG. 8 is a cross-sectional view taken on line 8—8 of FIG. 1 and illustrating the manner in which the invention pallet may be lifted with a lowboy.

The invention pallet also facilitates handling either by the forks of a forklift truck or by lowboys. Specifically, the forks of a forklift truck may enter the pallet from any of the four sides of the pallet with the forks entering into the tunnels formed both crosswise and lengthwise between the legs. As best seen in FIG. 8, the pallet also provides access from two sides of the pallet by a lowboy 70 of the type including wheels 72 supporting a lift structure 74 which may be raised in known manner by jacking movement of a handle 76. Although the lowboy may not enter the pallet from the sides parallel to the rib portions 14b, the lowboy may readily enter the pallet from either of the other two sides with the wheels 72 of the lowboy riding readily over the relatively thin obstruction provided by the planar lower or foot portion 14a of the base structure for movement into the apertures 14c to allow the wheels 72 of the lowboy to be positioned on the pallet support surface 78 and provide a reaction surface to allow the pallet to be raised above the support surface in response to jacking movement of the handle 76.

Whereas a preferred embodiment of the invention has been illustrated and described in detail, it will be apparent that various changes may be made in the disclosed embodiment without departing from the scope or spirit of the invention.

I claim:

1. A pallet comprising:

a plastic upper structure including an upwardly facing load receiving surface, defined by a first upper plastic sheet including a plurality of downwardly extending hollow portions opening in said load receiving surface, and downwardly facing attachment surface means defined by a second lower plastic sheet including a plurality of downwardly extending upwardly opening hollow portions nestingly receiving said downwardly extending hollow portions of said first sheet with the lower portions of the hollow portions of said first sheet fused to the lower portions of the hollow portions of said second sheet; and a base structure positioned beneath said upper structure and including a base plastic structure having a configuration generally corresponding to the configuration of said upper structure and a plurality of beam members incorporated in said base plastic structure and extending parallel to said load receiving surface, said base plastic structure including a third upper plastic sheet having an upper surface defining an upwardly facing detachment surface means fused to said attachment surface means of said upper structure and a fourth lower plastic sheet having a lower surface defining a flat lower surface to support the pallet on a support surface, selectively fused to the third upper sheet, and selectively spaced from the third upper sheet to accommodate said beam members.

2. A pallet structure according to claim 1 wherein:

said main body plastic structure includes a plurality of legs extending downwardly from said platform section; and said attachment surface means are defined at the bottom of said legs.

3. A pallet according to claim 2 wherein:

said base structure includes a plurality of raised portions extending from a location proximate one side edge of said base structure to a location proximate another side edge of said base structure; and a beam member is coextensive with each raised portion.

4. A pallet according to claim 3 wherein:

said raised portions are hollow and are formed of plastic; and said beams are metallic and one beam member is received in the hollow of each raised portion.

5. A pallet according to claim 1 wherein:

each beam member comprises a metallic tubular beam.

6. A pallet according to claim 1 wherein:

said base structure includes a generally planar lower portion and said beam members are positioned on said planar lower portion.

7. A pallet according to claim 6 wherein:

said base structure further includes a plurality of hollow rib portions upstanding from said lower planar portion and defining hollows; and said beam members are respectively positioned in the hollows of said rib portions.

8. A pallet comprising:

a main body plastic structure defining a planar platform section defining an upwardly facing load receiving surface defined by a first upper plastic sheet and downwardly facing attachment surface means defined by a second lower plastic sheet; and a base structure positioned beneath said platform section, secured to said attachment surface means, and including a plurality of metallic tubular beam members extending parallel to said load receiving surface and a base plastic structure having a configuration generally corresponding to the configuration of said main body plastic structure and including a plastic housing encapsulating each beam member;

each plastic housing being constituted by a first plastic sheet overlying the beam member fused to a second plastic sheet underlying the beam member.

9. A pallet comprising:

a main body plastic structure defining a planar platform section defining an upwardly facing load receiving surface defined by a first upper plastic sheet and a downwardly facing attachment surface defined by a second lower plastic sheet; and a twin sheet base structure positioned beneath said platform section, secured to said attachment surface, and including a plurality of metallic tubular beam members extending parallel to said load receiving surface and a base plastic structure having a configuration generally corresponding to the configuration of said main body plastic structure and including upper and lower sheets selectively fused together to define a plastic housing encapsulating each beam member.

10. A pallet according to claim 9 wherein:

said base structure is secured to said plastic structure by fusing upper surfaces of said plastic housings to lower surfaces of said main body plastic structure.

11. A pallet according to claim 10 wherein said plastic structure includes a plurality of legs extending downwardly from said platform section, said attachment surface is defined by the lower faces of said legs, and said base structure is fused to the lower faces of said legs.

12. A pallet comprising:

a plastic upper structure including an upwardly facing load receiving surface, defined by a first upper plastic sheet including a plurality of downwardly extending hollow portions opening in said load receiving surface, and downwardly facing attachment surface means spaced below said load receiving surface and defined by a second lower plastic sheet including a plurality of downwardly extending upwardly opening hollow portions positioned in nesting relation with respect to said downwardly extending hollow portions of said first sheet with the lower portions of the hollow portions of said first sheet fused to the lower portions of the hollow portions of said second sheet; and a plastic base structure including a third upper plastic sheet having an upper surface defining upwardly facing attachment surface means fused to the downwardly facing attachment surface means of said upper structure, and a fourth lower sheet positioned beneath said third sheet, having a lower surface defining a flat lower surface to support the pallet on a support surface, selectively fused to said third sheet, and selectively spaced from said third sheet to define spaces therebetween said fused upper and base structures coacting to define tunnels therebetween for the entry of material handling equipment;

said base structure including aperture means extending therethrough to allow elements of material handling equipment positioned in said tunnels to access the support surface to facilitate the lifting of the pallet.

13. A pallet according to claim 12 wherein:

said downwardly facing attachment surface means are defined by the bottoms of said legs of said second sheet.

14. A pallet comprising:

a twin sheet plastic upper structure defining an upwardly facing load receiving surface, defined by a first upper plastic sheet including a plurality of downwardly extending hollow portions opening in said load receiving surface, and downwardly facing attachment surface means spaced below said load receiving surface defined by a second lower plastic sheet including a plurality of downwardly extending upwardly opening hollow portions nestingly receiving said downwardly extending hollow portion of said first sheet with the lower portions of the hollow portions of said first sheet fused to the lower portions of the hollow portions of said second sheet; and a plastic base structure including a third upper plastic sheet having an upper surface defining upwardly facing attachment surface means fused to the downwardly facing attachment surface means of said upper structure, and a forth lower sheet positioned beneath said third sheet, having a lower surface defining a flat lower surface to support the pallet on a support surface, selectively fused to said third sheet, and selectively spaced from said third sheet to define spaces therebetween;

said fused upper and base plastic structures coacting to define tunnels therebetween for the entry of material handling equipment.

15. A pallet comprising:

a plastic structure including a planar platform section defining an upwardly facing load receiving surface and a plurality of legs extending downwardly from said platform section to define tunnels therebetween for receipt of the forks of a forklift truck; and a base structure extending beneath and secured to said plastic upper structure and including a plurality of beam structures;

said beam structures being arranged in a parallel fashion beneath said plastic upper structure;

said legs being arranged in parallel rows beneath said platform section;

each beam structure being arranged beneath a row of legs;

said base structure including a planar lower portion and a plurality of parallel hollow rib portions upstanding from said lower portion and defining hollows;

each beam structure comprising a beam member received in the hollow of a respective rib portion.

16. A pallet according to claim 15 wherein:

each beam member comprises a metallic tubular beam.

17. A pallet according to claim 16 wherein:

said base structure includes a first upper plastic sheet and a second lower plastic sheet;

said upper and lower sheets are fused together to form said planar lower portion;

said rib portions are formed as raised portions of said upper sheet; and each beam is received in the hollow of a respective rib portion with a section of said upper sheet overlying the beam and a section of the lower sheet underlying the beam.

18. A pallet comprising:

a plastic upper structure defining a planar platform section defining an upwardly facing load receiving surface and a plurality of legs arrayed in rows extending downwardly from said platform section with the bottoms of said rows defining downwardly facing attachment surface means;

a plastic base structure positioned beneath said upper structure and including upwardly facing attachment surface means confronting said downwardly facing attachment surface means and a flat lower surface spaced below said upwardly facing attachment surface means and adapted to support the pallet on a support surface, said base structure defining hollows and being fused to said plastic upper structure at the confronting interface of said attachment surface means to form a unitary plastic pallet with the fused structures coacting to define tunnels therebetween for the entry of material handling equipment;

beam members positioned in said hollows in parallel relation with each beam member positioned generally beneath a respective row of legs; and aperture means comprising openings extending through said base structure between adjacent beam members to allow elements of material handling equipment positioned in said tunnels to access the support surface to facilitate the lifting of the pallet.

* * * * *